US005767400A

United States Patent [19]

Nakano et al.

[11] Patent Number: 5,767,400

[45] Date of Patent: Jun. 16, 1998

[54] HYDRAULIC TEST SYSTEM MOUNTED WITH BOREHOLE TELEVISION SET FOR SIMULTANEOUS OBSERVATION IN FRONT AND LATERAL DIRECTIONS

[75] Inventors: Katsushi Nakano; Koichi Yanagisawa, both of Toki; Yoichi Hirata, Tokyo; Kazuyuki Goto, Tokyo; Masahiko Tamura, Tokyo; Shunichi Kamewada, Sapporo, all of Japan

[73] Assignees: Doryokuro Kakunenryo Kaihatsu Jigyodan; Taisei Kiso Sekkei Co. Ltd., both of Tokyo; Raax Co., Ltd., Sapporo, all of Japan

[21] Appl. No.: 677,527

[22] Filed: Jul. 10, 1996

[30] Foreign Application Priority Data

Jul. 10, 1995 [JP] Japan ..... 7-173363

[51] Int. Cl.[6] ..... G02B 23/24; G02B 5/08; E21B 47/00; G01N 3/28

[52] U.S. Cl. ..... 73/152.46; 73/152.36; 73/152.13; 166/250.03; 166/254.1; 166/255.2

[58] Field of Search ..... 73/152.46, 152.36, 73/152.52, 152.11, 152.13, 152.39; 166/254.1, 250.03, 250.08, 250.04, 255.1, 255.2

[56] References Cited

U.S. PATENT DOCUMENTS

| | | | |
|---|---|---|---|
| 2,971,259 | 2/1961 | Hahnau et al. | 33/1 |
| 3,258,963 | 7/1966 | Bryant et al. | 73/155 |
| 3,373,440 | 3/1968 | Jenkins et al. | 346/107 |
| 3,743,017 | 7/1973 | Fast et al. | 166/249 |
| 4,779,201 | 10/1988 | Iizuka et al. | 364/422 |
| 4,852,182 | 7/1989 | Herbin et al. | 382/1 |
| 5,277,062 | 1/1994 | Blauch et al. | 73/153 |
| 5,318,123 | 6/1994 | Venditto et al. | 166/250 |
| 5,350,018 | 9/1994 | Sorem et al. | 166/250 |
| 5,353,637 | 10/1994 | Plumb et al. | 73/151 |
| 5,467,640 | 11/1995 | Salinas | 73/40.5 R |
| 5,511,429 | 4/1996 | Kosugi et al. | 73/784 |
| 5,543,972 | 8/1996 | Kamewada | 359/834 |

*Primary Examiner*—Hezron E. Williams
*Assistant Examiner*—J. David Wiggins
*Attorney, Agent, or Firm*—Armstrong, Westerman, Hattori, McLeland & Naughton

[57] ABSTRACT

The present invention provides a hydraulic test system, by which it is possible to select a proper position and to select a reliable measurement interval corresponding to said position, to obtain information for preventing retention or leaving of the equipment in the borehole, and to observe the conditions in front and lateral directions by a single BTV at the same time and at wide angle of view without adjusting focal point. On the tip of a measurement pipe to be inserted into a borehole, a waterproofing cylinder with a transparent window oriented for simultaneously observing in both the front and lateral directions is mounted, and there are provided illumination units for illuminating in front direction and side walls and a borehole television set equipped with a ball lens, spherical mirror lens or matched convex pair of lens system in said cylinder, which forms a virtual image of an object in front direction and a reflected virtual image of an object in lateral direction on almost the same plane.

7 Claims, 5 Drawing Sheets

HYDRAULIC TEST SYSTEM MOUNTED WITH BOREHOLE TELEVISION SET FOR SIMULTANEOUS OBSERVATION IN FRONT AND LATERAL DIRECTIONS

BACKGROUND OF THE INVENTION

The present invention relates to a hydraulic test system for performing: (1) a survey to identify hydrological characteristics of rocks in the fields of underground space utilization, civil engineering, petroleum industry or geothermal energy; (2) a survey for identifying condition or frequency of collapsed zones or cracks in a borehole and changes in rock facies; and (3) a test or a survey at site utilizing other borehole. The invention relates in particular to a hydraulic test system having at its tip a borehole television set ("BTV") for simultaneously observing in front and lateral directions.

The problems in the survey utilizing borehole are roughly divided into the following three categories:

(a) to select the most suitable position for the required data quality and depth according to the information obtained in the borehole;

(b) to set up a measurement interval reliably at the selected position and to perform test according to the most suitable method for the conditions of the rock; and (c) to prevent retention or leaving of the tester in the borehole during collapses which frequently occur in the borehole.

To solve the above problems, a method is widely propagated at present, which is to repeatedly survey using the same borehole by combining existing techniques. By this method, it is possible to solve the problems described in (a) above, while, in solving the problems described in (a), it is not possible to set up a reliable test sector based on the information obtained in (a) because of the error in depth in the data obtained by various types of testers due to extension of the tester inserted into the borehole. There are also problems related to working efficiency and economic feasibility because repeated tests are required, and the risk of the retention of the tester in the hole due to collapse in the borehole is also high.

As a combination of the borehole television set (BTV) and the hydraulic test system, a permeability test equipment incorporated with BTV has also been developed.

The aim of the permeability test equipment incorporated with BTV is to evaluate conditions of fracture and to investigate a (hydrological property of) main flow pass by incorporating BTV for observing in lateral direction in the measurement interval. Thus, it is possible to obtain detailed information on side wall of the borehole, while BTV is not provided at the tip of the equipment and the conditions in front direction cannot be observed. As a result, the obtained information is only partial and the information in front direction cannot be obtained. For this reason, the information relating to the three problems as described in (a) to (c) above is not yet obtainable in detail.

The BTV as developed so far is roughly divided into two types. One is a front monitor type, by which an image of the condition in front direction can be obtained by a television camera directed toward front direction, and the other is a lateral monitor type, by which an image of wall surface in the borehole can be obtained by means of a plane mirror or a prism tilted by 45° with respect to axial direction of the hole.

Up to now, there has been none of such BTVs having the above two functions. In case it is tried to obtain the images in front and lateral directions at the same time by combining the above existing techniques, two television cameras are needed, and the tester itself must be bigger in size.

Further, almost all of the existing BTVs are placed into the borehole by means of cable, and longer cable is required as the depth becomes deeper, and depth error cannot be eliminated even when depth is corrected in comparison with core sample, which is obtained by drilling of the borehole.

SUMMARY OF THE INVENTION

To solve the above problems, it is an object of the present invention:

(a) to make it possible to select the most suitable position depending upon data quality required or depth according to the information of conditions in the borehole;

(b) to perform a test by the most suitable method for the condition of rock by reliably selecting a measurement interval at the selected position;

(c) to obtain information for preventing retention of the tester in the hole in the event of collapses frequently occurring in the borehole; and (d) to make it possible to observe in front and lateral directions at the same time at wide angle and without adjusting focal length using a BTV.

To attain the above object, the hydraulic test system according to the present invention comprises a downhole unit having a BTV mounted on the tip of a hollow measurement pipe inserted into a borehole and used for observing the conditions inside the borehole and outer packers for selecting a measurement interval by means of expansion, and provided with functions to perform hydraulic test and a relay unit having an inner probe to play supplementary role such as water pressure measurement in the hydraulic test for the selected measurement interval, a cable for transmitting and receiving signals for power supply, control and observation to and from the downhole unit, and measurement pipes for supplying and discharging water, and a surface unit having a control unit for controlling hydraulic testing functions and BTV in the downhole unit, a data processing unit for recording and analyzing measured or observed data, and cable drum units for winding up said cable and said inner probe, whereby said BTV makes it possible to observe in front and lateral directions at the same time.

Also, the BTV according to the present invention comprises an image forming optical system, illumination units for illuminating in front direction and lateral wall arranged near said image forming optical system, and a television camera positioned on the same optical axis as that of the image forming optical system, these components being placed in a waterproofing cylinder with a transparent window to observe in front direction and lateral wall.

Also, the present invention is characterized in that the image forming optical system comprises a spherical mirror, and the focal point of a front lens unit of the spherical mirror is inside the focal point of a rear lens unit of the spherical mirror.

Also, the present invention is characterized in that the image forming optical system comprises a biconvex lens having spherical convex surface and short focal length with a spacer placed therebetween, an inverted virtual image of an object in front direction is formed inside the lens, and a virtual image of an object in lateral direction is formed by spherical convex surface of the rear convex lens on or near a plane where said inverted virtual image is formed.

Further, the present invention is characterized in that the image forming optical system comprises a front and a rear semi-convex lenses having short focal lengths with convex surfaces of the two lenses facing in opposite directions, the distance between the lenses being made adjustable, an inverted virtual image of an object in front direction is formed inside the focal point of a rear semi-convex lens, and a virtual image of an object in lateral direction is formed by the spherical convex surface of the rear semi-convex lens on or near a plane where said inverted virtual image is formed.

Further, the present invention is characterized in that the image forming optical system comprises a front semi-convex lens and a rear semi-convex lens having short focal lengths with convex surfaces of the two lenses placed face-to-face to each other, the distance between the two lenses being made adjustable, rear surface of the rear semi-convex lens is formed in spherical convex surface, a transparent body in form of a concave lens engageable with said spherical convex surface is attached on it, an inverted virtual image of an object in front direction is formed inside the focal point of the rear semi-convex lens, and a virtual image of an object in lateral direction is formed by a spherical convex surface arranged on rear surface of the rear semi-convex lens on or near a plane where said inverted virtual image is formed.

Also, the present invention is characterized in that the image forming optical system comprises a concave lens having short focal length and having a front end surface of a transparent cylindrical block being formed as a concave mirror surface, a virtual image of an object in front direction is formed by the convex lens having short focal length, and a virtual image of an object in lateral direction is formed by the concave mirror surface on or near a plane where the virtual image of said object in front direction is formed.

In the present invention, a hydraulic test system used for a depth of 1000 m to identify permeability (easiness to pass water) of rock utilizing a borehole is combined with a BTV. As a result, the function to select the suitable position and the function to set a measurement interval reliably at the selected position and to perform the test are combined in a single tester. Also, BTV is arranged at the tip of the tester for observing in front and lateral directions at the same time, whereby image information for preventing retention of the tester in case of collapse in the borehole is obtained by the front image, and the condition of rock can be identified in detail by the lateral image.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DETAILED DESCRIPTION OF THE PREFERRED EMBODIMENTS

Figure 1:
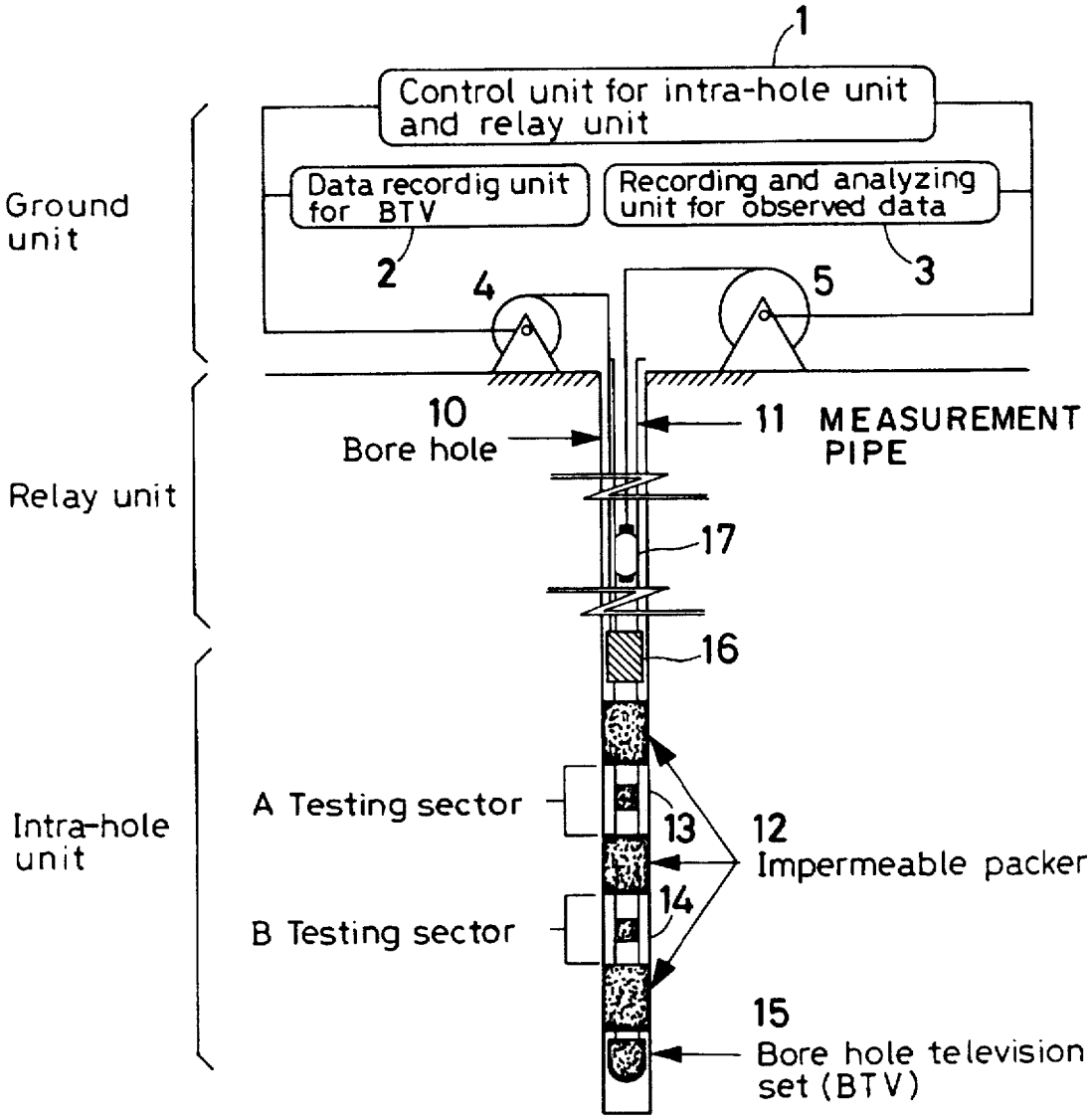
FIG. 1 is a drawing to show a basic concept of an overall arrangement of a tester of the present invention.

In the following, description will be given on embodiments of the present invention referring to the drawings.

In case permeability or water pressure in rock is measured using a borehole, it is necessary to identify in advanced conditions and frequency of the fracture in rock and change of rock facies. If the portions having high possibility of changes in permeability and water pressure can be detected from the above information and the test can be performed, the information on the rock conditions can be more extensively collected, and the reliability on analysis based on the information can be increased. If the tester can be reliably installed at the test position determined according to the information on rock conditions and the information can be obtained, which helps to avoid retention of the tester in the hole associated with collapse in the borehole, the reliability of the information obtained from the test is increased more, and the test can be carried out in safe and efficient manner.

In the following, description will be given on the arrangement of the tester of the present invention, on structure and principle of BTV, and on testing procedure.

The tester of the present invention comprises a downhole unit, a relay unit and a surface unit.

The surface unit comprises a control unit 1 for controlling the downhole unit and the relay unit, a data recording unit 2 for recording data observed in the borehole by BTV camera, a recording and analyzing unit 3 for recording and analyzing data during hydraulic test, and a cable drum unit 4 for a cable for transmitting and receiving signals of power supply, control and observation to and from the downhole unit, and a cable drum unit 5 for a cable to move an inner probe up and down. The data recording unit 2 and the recording and analyzing unit 3 have display units for image display, and an image of the condition in front direction and a vertically developed image obtained through computerized processing of an image of the borehole over total periphery can be observed at the same time.

The relay unit comprises an inner probe 17 moving up and down within a measurement pipe 11, i.e. a hollow pipe installed in the borehole 10, and various types of cable. The measurement pipe 11 comprises a plurality of pipes connected with each other by screw connection. The connection is sealed by O-ring to prevent leakage from the connection, and it can be extended to the predetermined depth by increasing the number of the connected pipes. The inner probe 17 has a structure, for example, comprising an inner packer, an electromagnetic valve, and a pore water pressure gauge. In case permeability test is performed by this probe, the inner packer is compressed with the measurement interval set up, and the main valve in a valve accommodating unit 16 is opened to fill the measurement pipe with water and to reduce water head difference for pore water pressure of measurement pipe, and intra-pipe water level is measured by the pore water pressure gauge. In case of low permeability, the inner packer is expanded to increase intra-pipe pressure, and pressure change is detected by the pore water pressure gauge.

The downhole unit comprises a plurality of outer packers 12 for setting the measurement interval, a valve accommodating unit 16, and a BTV camera 15 for observing inside the borehole. The outer packers 12 are mounted on the measurement pipe by screw connection, and strainers 13 and 14 comprising perforated tubes are used to connect between the packers, and the packers are communicated with each other through a connecting pipe. In the valve accommodating unit, a main valve and a valve for extending and compressing packers are arranged and these are controlled by a control unit installed on the ground. When the main valve is opened and the measurement pipe is moved down in the borehole, the measurement pipe is filled with underground water through the strainers 13 and 14. With the main valve closed, the valve for expanding packers is opened and pressure is applied in the measurement pipe. Then, the water in the measurement pipe is introduced into the packers, thus expanding them. When the valve for compressing the packers is opened, the water in the packers is discharged into the borehole. For the BTV camera 15, a lens optical system for observing in front and lateral directions as described later is adopted, and it is accommodated in a waterproofing transparent cylinder with illumination units around it.

Next, description will be given on the BTV camera of the present invention used for the above tester.

First, the principle for simultaneously observing in front and lateral directions by BTV camera of the present invention will be described.

Figure 2:
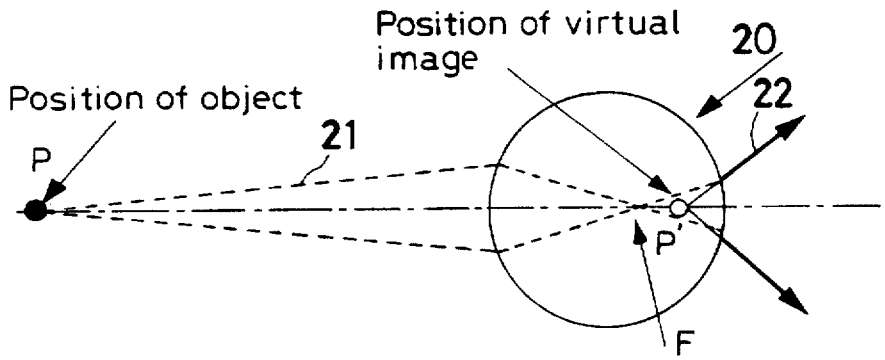
FIG. 2 is a drawing for explaining formation of a virtual image of an object in front direction by a spherical mirror.

FIG. 2 is a drawing for explaining the formation of a virtual image of an object in front direction by a ball lens. Light beams 21 (shown by broken lines in the figure) coming from an object placed at a position P in front direction of the spherical mirror 20 are converged by a front lens (convex lens) of the spherical mirror. When the focusing position F of the light beams is inside the focal point of a rear lens (convex lens) of the spherical mirror, the rear lens of the spherical mirror diffuses the light beams (as shown by solid lines 22). As a result, the light beams coming from the object in front direction becomes apparently equal to the light beams coming from a position closer to the rear lens, and a virtual image is formed at this position P'.

As described above, in a spherical lens, which is a combination of two convex lenses, when the focal point of the front convex lens is inside the focal point of the rear convex lens, the lens system as a whole gives diffusion effect to the light beams. As a result, the light beams coming from the object in front direction are apparently equalized with the light beams coming from a position closer to the rear lens, and an inverted virtual image is formed at this position.

Figure 3:
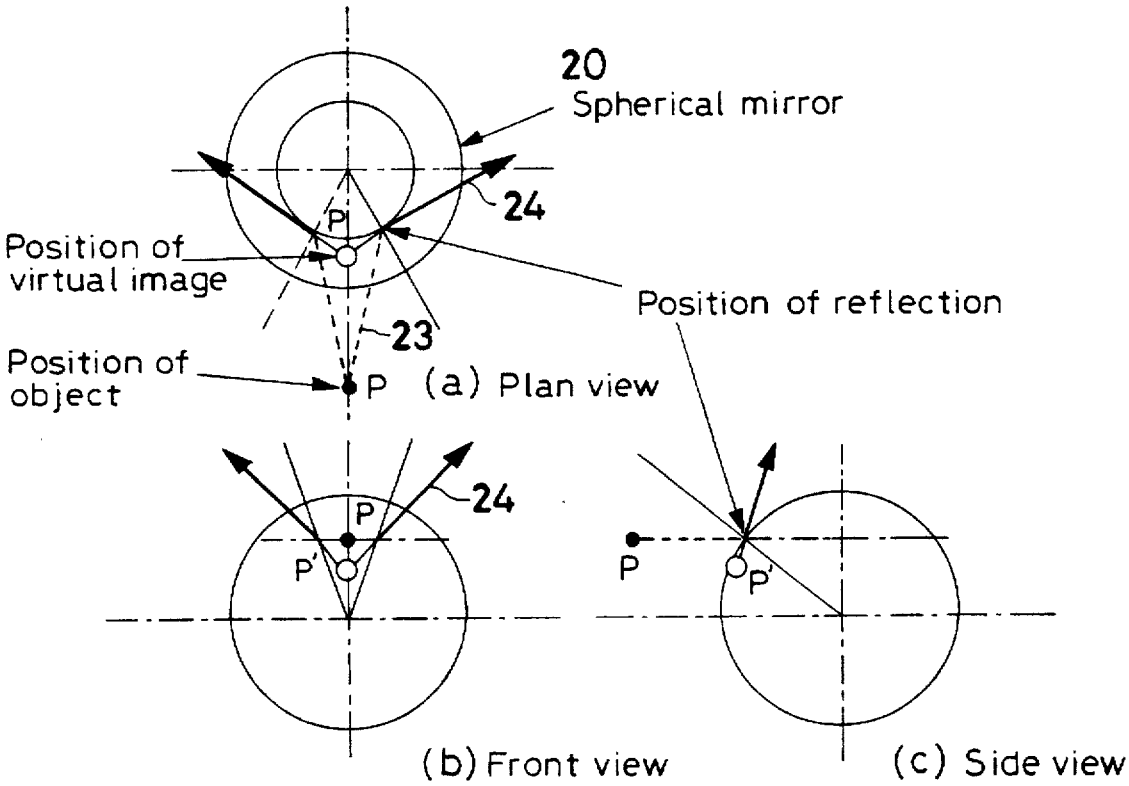
FIG. 3 is a drawing for explaining formation of a virtual image of an object in lateral direction by a spherical mirror.

Next, description will be given on formation of a virtual image of an object in lateral direction by the spherical mirror in connection with FIG. 3. (FIG. 3(*a*) is a plan view, 3(*b*) is a front view, and FIG. 3 (*c*) is a side view).

The light beams 23 (shown by broken lines in the figure) coming from an object in lateral direction at a position P are reflected upward by the surface of the spherical mirror 20 and are diffused. The apparent crossing position of the reflected diffusion light beams (solid lines 24) is behind and immediately below the lens surface. As a result, a reflected virtual image is formed at this position.

In this way, the inverted virtual image and the reflected virtual image by the spherical lens (a combination of convex lenses) can be formed at the positions very closer to each other or on the same plane by combining convex lenses with short focal lengths. Therefore, the images can be observed at the same time by a television camera placed on the same optical axis without changing focal point. Also, the optical system of this structure has a wide angle of view. This is not only suitable for observing a structure in cylindrical shape such as a borehole, but also the depth of field is very deep because there is relatively less change in image position with respect to change in the distance to object position. As a result, it is not necessary to adjust focus by approaching toward the object to be observed. In this principle, the situation will be the same if the combination of convex lenses is replaced by concave lenses, and the only difference is that an erect image of the object in front direction is formed. Next, description will be given on an embodiment of a lens system of the BTV camera of the present invention.

In the present invention, it is necessary to design the BTV in compact size and to observe in two directions, i.e. in front and lateral directions, at the same time by a single television camera. Therefore, a structure where images in front and lateral directions are formed on the same focal plane is required in the present invention. Also, it is desirable that an image of very wide angle can be obtained because it is aimed to observe within a very narrow borehole.

Figure 4:
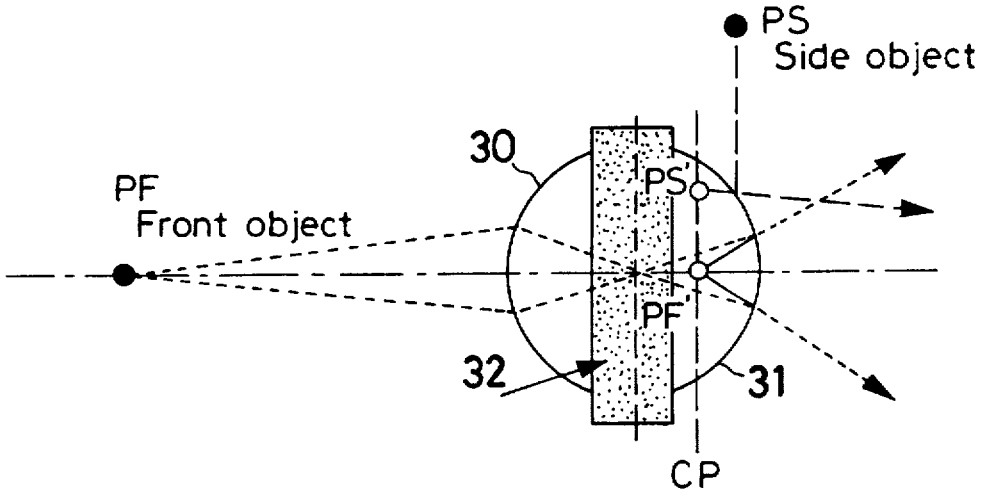
FIG. 4 is a drawing of the optical system in a BTV used for explaining an embodiment of a mirror lens of the present invention.

FIG. 4 is a drawing of an embodiment of a mirror lens of the present invention.

In this embodiment, a biconvex-lens having very short focal length is used, and an inverted virtual image of an object in front direction is formed in it. Also, by forming the surface of the lens as a ring-like convex mirror face, a virtual image of an object in lateral direction is formed on or near the plane where the virtual image of the convex lens is formed.

In FIG. 4, convex lenses 30 and 31 are lenses having very short focal lengths, and position of image formation is adjusted by changing thickness of a transparent spacer 32, which is placed between the lenses. The light beams coming from an object PF in front direction are converged by the front convex lens 30, pass through the transparent spacer 32 and enter the rear convex lens 31. Because the focal point of the front convex lens 30 is inside the focal point of the rear convex lens 31, the light beams are diffused, and an inverted virtual image PF' is formed. On the other hand, the light beams coming from an object PS in lateral direction are reflected by the surface of the rear convex lens 31, and a reflected virtual image PS' is formed. The virtual image PF' of the front object and the virtual image PS' of the lateral object can be formed on almost the same common plane CP. As a result, it is possible to observe an image in front direction and an image over total periphery in lateral direction can be observed at the same time by a single television camera placed on the same optical axis without changing focal point.

Figure 5:
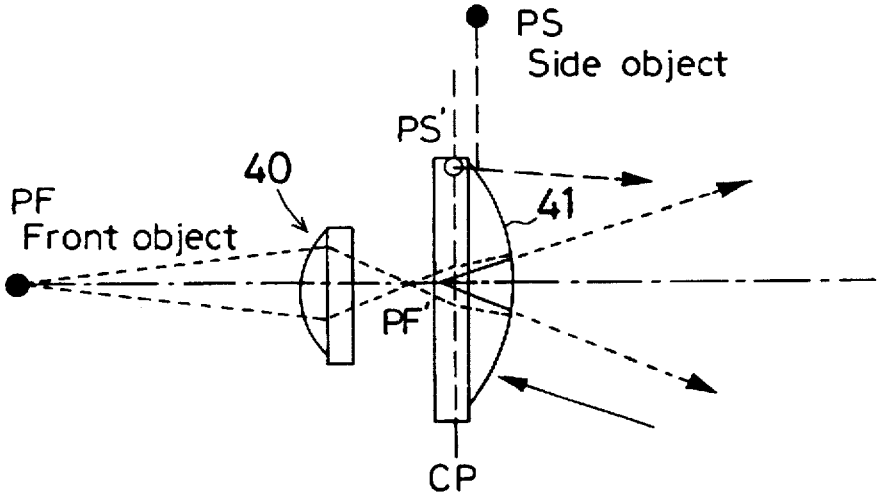
FIG. 5 is a drawing of the optical system in a BTV used for explaining another embodiment of the mirror lens of the present invention.

FIG. 5 shows another embodiment of the mirror lens.

In this embodiment, two semi-convex lenses having very short focal lengths are placed with the convex surfaces facing toward opposite directions, an inverted virtual image of an object in front direction is formed in it, and position of the virtual image can be adjusted by changing the distance between the lenses. On the other hand, the surface of the rear lens is formed as a ring-like convex mirror, and a virtual image of the object in lateral direction is formed on or near a plane where the virtual image by the front convex lens is formed.

In FIG. 5, the front semi-convex lens 40 and the rear semi-convex lens 41 are placed with convex surfaces facing in opposite directions, and these are adjusted in such manner that the focal plane of the front semi-convex lens 40 is inside the focal point of the rear semi-convex lens 41. The light beams coming from the front object PF are converged by the front semi-convex lens 40 and are diffused by the rear semi-convex lens 41, and an inverted image PF' is formed. On the other hand, the light beams coming from the object in lateral direction are reflected by the surface of the rear semi-convex lens 41, and a reflected virtual image PS' is formed. The virtual image PF' of the object in front direction and the virtual image PS' of the object in lateral direction by the rear lens are formed on almost the same common plane CP. As a result, it is possible to observe the images in front and lateral directions at the same time by a single television camera placed on the same optical axis without changing focal point.

Figure 6:
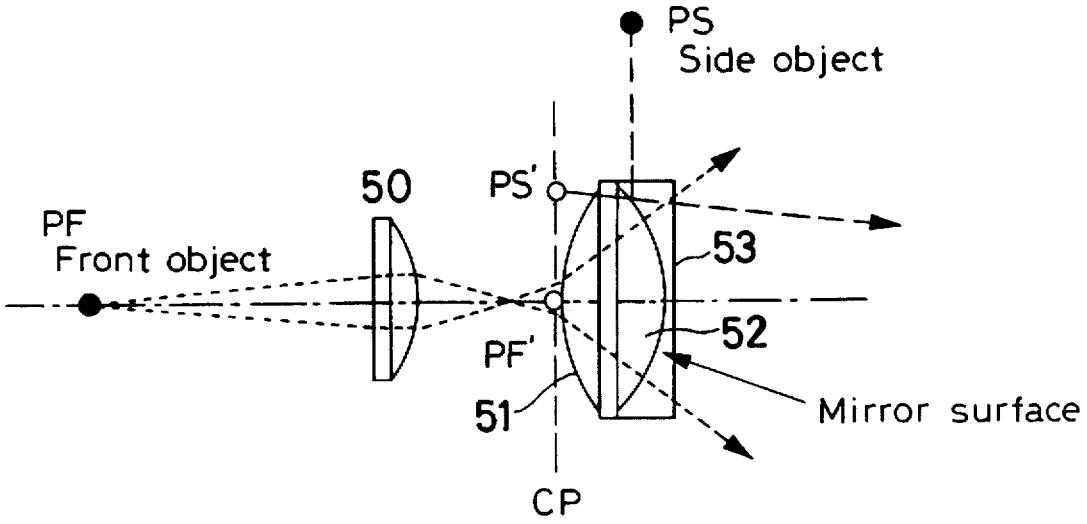
FIG. 6 is a drawing of the optical system in a BTV used for explaining still another embodiment of the mirror lens of the present invention.

FIG. 6 shows another embodiment of the mirror lens.

In this embodiment, two semi-convex lenses having very short focal lengths are placed with the convex surfaces placed face-to-face to each other, and an inverted virtual image of an object in front direction is formed inside the focal point of the rear semi-convex lens, and the position of the virtual image is made adjustable by changing the distance between the lenses. On the other hand, rear surface of the rear semi-convex lens is formed as a ring-like convex mirror, and a concave transparent body engageable with it is attached on it so that the convex mirror is sealed inside.

In FIG. 6, the front semi-convex lens 50 and the rear semi-convex lens 51 are placed with the convex surfaces placed face-to-face to each other, and the distance between the two lenses are adjusted in such manner that the focal plane of the front semi-convex lens 50 is inside the focal point of the rear semi-convex lens 51. Further, a ring-like convex mirror 52 is arranged on the rear surface of the semi-convex lens 51, and a transparent body 53 in form of a concave lens engageable with the convex surface is attached on it. The light beams coming from the object in front direction are converged on the front semi-convex lens 50 and are diffused through the rear semi-convex lens 51 and the convex mirror 52, and an inverted virtual image PF' is formed. On the other, hand, the light beams coming from the object PS in lateral direction are reflected by the surface of the convex mirror 52 (i.e. boundary surface between the convex mirror and the transparent body 53 in form of a concave lens), and a reflected virtual image PS' is formed. The virtual image PF' of the object in front direction and the virtual image PS' by the rear lens are formed on almost the same common plane CP. As a result, the image in front direction and the image over total periphery in lateral direction can be observed at the same time by a single television camera placed on the same optical axis without changing focal point.

Figure 7:
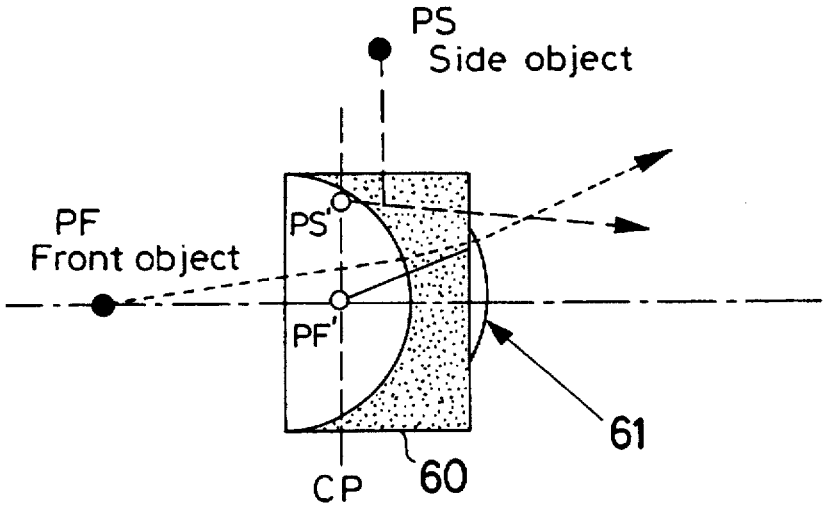
FIG. 7 is a drawing of the optical system in a BTV used for explaining yet still another embodiment of the mirror lens of the present invention.

FIG. 7 shows still another embodiment of the mirror lens.

This embodiment uses a concave lens. An end surface of a transparent cylinder block is fabricated in convex shape, and using this surface as a ring-like mirror surface, a virtual image of an object in lateral direction is observed. On the other hand, using the center of the cylinder block as a concave lens with short focal length, a virtual image of an object in front direction is observed.

In FIG. 7, reference numeral 60 represents a concave lens formed by fabricating an end surface of a transparent cylinder block in the formed shape of a concave surface. On rear surface, a lens 61 for adjusting focal plane is arranged. The light beams coming from an object in front direction PF are diffused through the concave lens 60, and an erect virtual image PF' is formed. The position of the erect virtual image PF' is adjusted by the focal plane adjusting lens 61. On the other hand, the light beams coming from an object in lateral direction PS are reflected by the concave surface of the concave lens 60, and a reflected virtual image PS' is formed. In this case, the virtual image PF' of the object in front direction and the virtual image PS' of the object in lateral direction ate formed on almost the same common plane CP. As a result, an image in front direction and an image in lateral direction over total periphery can be observed at the same time by a single television camera placed on the same optical axis without changing focal point.

Around the mirror lenses as described above, illumination units are arranged in front direction and over total periphery of side wall. Also, a television camera is installed on the same optical axis. These are accommodated in a waterproofing cylinder with a transparent window, through which observation can be made in front and lateral directions, and this is placed at the tip of the hydraulic test system.

Next, description will be given on testing procedure of the tester according to the present invention in connection with FIG. 8.

Figure 8:
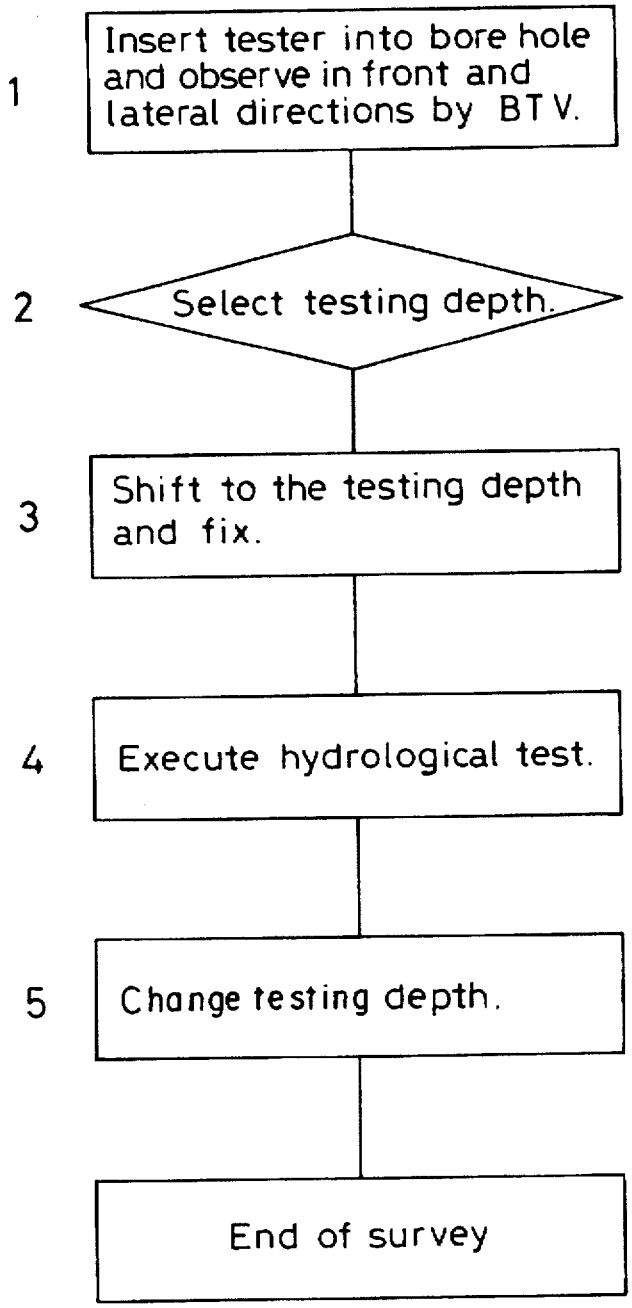
FIG. 8 is a flow chart of testing procedure.

FIG. 8 is a flow chart of a testing procedure of the tester of the present invention. Borehole is drilled in advance prior to the use of the tester of the present invention.

(1) Insertion of the Tester into Borehole and Observation by BTV

A downhole unit (FIG. 1) of the tester is placed into the borehole, and wall of the hole is observed by BTV from the ground surface to the bottom of the hole (the lowermost end of the borehole). In this observation process, based on the image obtained by front monitoring function, observation is continuously performed to find out whether the situation is present or not, which makes the insertion of tester difficult due to collapse and the like. If there is a situation to make the further insertion difficult, the insertion of this tester is stopped at the present depth, and testing depth is selected for the sector, which is shallower than the above depth. For the depth deeper than the point where the situation to make the insertion difficult is observed, proper action should be taken to prevent collapse inside the borehole, and the tester is inserted again and the test is performed thereafter at such deeper depth.

(2) Selection of Testing Depth

Based on the results of observation on wall of the hole performed in (1), the measurement interval is selected.

(3) Shifting to the Measurement Interval (Position Detected by BTV) and Fixing

While observing the wall of the hole again by BTV, the tester is moved. In view of the results of the observation in (1), the tester is installed in the measurement interval as set up in (2).

(4) Execution of Hydraulic Test

The impermeable packer is expanded, and hydraulic test is performed. After the completion of the test, the packer is compressed.

(5) Change of Testing Depth

By the same procedure as in (3), the tester is moved to the next measurement interval, and hydraulic test is performed. Then, the procedures from (3) to (5) are performed repeatedly until the test will be completed.

As described above, it is possible to attain the following effects according to the present invention:

By an image in front direction and an image in lateral direction obtained by BTV camera, it is possible to have overall image information from several meters ahead to this side and detailed image information in the range of several centimeters. Thus, the conditions of rock can be identified in detail, and the most suitable testing position can be set up.

Because the hydraulic test system has a BTV at its tip, the measurement interval can be reliably set at the predetermined testing position, and, no depth error occurs.

From the image in front direction obtained by BTV, image information from several meters ahead in the borehole can be obtained, and this makes it possible to prevent retention of the tester in the hole caused by collapse in the hole.

The dual acting or focusing ball lens of BTV is designed in such compact size that observation can be performed in front and lateral directions at the same time. Even when a single BTV is used for various types of survey, abundant image information in the borehole can be efficiently provided.

What we claim are:

1. A hydraulic test system having a simultaneous observation type borehole television set for observing in front and lateral directions at the same time, comprising:

a downhole unit including a borehole television set ("BTV"), having a television camera, mounted on the tip of a hollow measurement pipe inserted into a borehole, and outer packers for selecting a measurement interval by means of expansion, and provided with functions to perform hydraulic test;

a relay unit having at least an inner probe to play supplementary role in hydraulic testing operations and borehole viewing support functions such as water pressure measurement in hydraulic test for the selected measurement interval, a cable for transmitting and receiving signals for power supply, control and observation to and from the downhole unit, and said relay unit having pipes for supplying and discharging water; and a surface unit having a control unit for controlling hydraulic testing functions and BTV in the downhole unit, a data processing unit for recording and analyzing measured or observed data, and cable drum units for said cable and said inner probe.

2. A hydraulic test system according to claim 1, wherein said BTV has an image forming optical system, and illumination units arranged near said image forming optical system and used for illuminating in front direction and side wall, said television camera being placed on the same optical axis as that of the image forming optical system, and said image forming optical system, said illumination units, and said television camera being placed in a waterproofing cylinder with a transparent window for observing in front direction and side wall of the borehole.

3. A hydraulic test system according to claim 2, wherein said image forming optical system comprises a spherical mirror, and focal point of a front lens unit of the spherical mirror is inside the focal point of a rear lens unit of the spherical mirror.

4. A hydraulic test system according to claim 2, wherein said image forming optical system comprises a biconvex lens having spherical convex surface and short focal length with a spacer placed therebetween, an inverted virtual image of an object in front direction is formed inside the lens, and a virtual image of an object in lateral direction is formed by the spherical convex surface of a rear convex lens on or near a plane where said inverted virtual image is formed.

5. A hydraulic test system according to claim 2, wherein said image forming optical system comprises a front semi-convex lens and a rear semi-convex lens having short focal lengths with convex surfaces of the two lenses facing in opposite directions, the distance between the lenses being made adjustable, an inverted virtual image of an object in front direction is formed inside the focal point of the rear semi-convex lens, and a virtual image of an object in lateral direction is formed by the spherical convex surface of the rear semi-convex lens on or near a plane where said inverted virtual image is formed.

6. A hydraulic test system according to claim 2, wherein said image forming optical system comprises a front semi-convex lens and a rear semi-convex lens having short focal lengths with convex surfaces of the two lenses placed face-to-face to each other, the distance between the two lenses being made adjustable, rear surface of the rear semi-convex lens is formed in spherical convex surface, a transparent body in form of a concave lens and engageable with the spherical convex surface is attached on it, an inverted virtual image of an object in front direction is formed inside the focal point of the rear semi-convex lens, and a virtual image of an object in lateral direction is formed by the spherical convex surface arranged on the rear surface of the rear semi-convex lens on or near a plane where said inverted virtual image is formed.

7. A hydraulic test system according to claim 2, wherein said image forming optical system comprises a concave lens having short focal length with a front end surface of a transparent cylinder block being formed as a concave mirror surface, a virtual image of an object in front direction is formed by the convex lens having short focal length, and a virtual image of an object in lateral direction is formed by the concave mirror surface on or near a plane where the virtual image of the object in front direction is formed.

* * * * *